United States Patent [19]

Brewer et al.

[11] Patent Number: 4,970,918

[45] Date of Patent: Nov. 20, 1990

[54] ADJUSTABLE TOOL

[75] Inventors: Daniel J. Brewer; Bobby B. Blasingame; Charles T. Thomas, all of Brownwood, Tex.

[73] Assignee: B. B. T. Tool Company, Brownwood, Tex.

[21] Appl. No.: 278,723

[22] Filed: Dec. 8, 1988

[51] Int. Cl.[5] ..... B25B 17/00

[52] U.S. Cl. ..... 81/57.29; 81/57.36; 81/57.22; 81/57.5

[58] Field of Search ..... 81/57.29, 57.13, 57.26, 81/57.28, 57.36, 57.22, 57.45, 57.46, 57.5, 177.8, 177.7

[56] References Cited

U.S. PATENT DOCUMENTS 966,529 8/1910 Cunningham ..... 81/57.5

2,791,142 5/1957 Lyon ..... 81/57.26

*Primary Examiner*—D. S. Meislin

*Attorney, Agent, or Firm*—David Ostfeld

[57] ABSTRACT

An apparatus and method for manipulating a fastening device such as a bolt or screw is disclosed. The apparatus comprises a handle which has a rotatable shaft inserted through the handle. A housing pivots about one end of the handle. A drive head is located in the housing and has an end which can be adopted to a socket or other device to fit the fastening device. The drive head pivots with the housing as the housing rotates about the handle. The longitudinal axis of the drive head can be aligned with the drive shaft, or the housing and drive head can be pivoted about the handle until the longitudinal axis of the drive head is perpendicular to the drive shaft, and a drive gear mechanically connects the drive shaft to the drive head. The drive shaft can be rotated to manipulate a fastening device at angles of 0°, 90°, and 270° from the drive shaft.

27 Claims, 2 Drawing Sheets

ADJUSTABLE TOOL

FIELD OF THE INVENTION

The present invention relates to an apparatus and method for manipulating fastening devices. More particularly, the present invention relates to an apparatus and method which uses an adjustable drive head to selectively manipulate fastening devices along axes which are perpendicular to or parallel to the drive axis.

BACKGROUND OF THE PRIOR ART

Various mechanical tools have been developed to manipulate fastening devices such as bolts and screws. For example, a ratchet drive socket wrench or power wrench permits torque to be efficiently applied to loosen or tighten a bolt when the drive shaft is parallel to the longitudinal axis of the bolt. Complications can arise, however, when the bolt is located at a position where the socket wrench or power wrench cannot reach the bolt.

Numerous mechanical devices have been developed to manipulate fastening devices which cannot be reached with conventional tools. For example, U.S. Pat. No. 4,620,459 to Singleton shows a speed socket wrench which uses a pinion gear to transfer rotation from a gear shaft to a drive shaft which is perpendicular to the gear shaft. A similar function is shown in U.S. Pat. No. 4,474,089 to Scott, which uses a handle, attached to a shaft, to drive a gear engaged with an integral shaft which is located perpendicular to the shaft. U.S. Pat. No. 4,242,931 to Clement shows a different tool which accomplishes the same function. A jack shaft is attached to one end of the jack shaft. The pinion gear drives a gear wheel attached to the socket end, which is perpendicular to the axis of the jack shaft. Each of the tools described above accomplishes the function of transferring force from a shaft to a perpendicular drive shaft.

Other tools have been developed to reach fastening devices. U.S. Pat. No. 2,791,142 to Lyon shows a multiple gear mechanism which acts as a universal joint in a drive shaft. U.S. Pat. No. 2,716,363 to Wasylow shows a shaft having a pinion gear which drives a gear attached to a perpendicular drive shaft. U.S. Pat. No. 2,316,243 to Hubbard shows a transmission live tool having an articulated handle which includes drive shafts located in each handle segment. Each drive shaft end includes gear teeth which mesh at varying angles of the handle segments. U.S. Pat. No. 1,861,326 to Sessions shows a screw driven jack which is powered by a handle connection to a drive shaft. The jack is operated in a direction perpendicular to the axis of the drive shaft.

While these tools can be used in specific applications, a need exists for an adjustable tool which can manipulate fastening devices which can not easily be reached by conventional tools.

SUMMARY OF THE INVENTION

The present invention provides an improved tool which can be adjusted to manipulate fastening devices. The invention generally comprises an elongate handle and a drive shaft, having a first end, second end, interposed within the handle. A drive head is pivotably engaged with the handle. The drive head includes a first end adaptable for manipulating the fastening device, and a second end for selective engagement with the second end of the drive shaft. A drive gear is engaged with the drive head and may be selectively engaged with the second end of the drive shaft when the second end of the drive head is not engaged with the drive shaft. When the second end of the drive shaft is engaged with either the drive head on the drive gear, operation of the first end of the drive shaft will cause the drive head to manipulate the fastening device.

The method of the invention is practiced by withdrawing the drive shaft within the handle to permit the drive head to pivot about an axis which is substantially perpendicular to the longitudinal axis of the handle. The second end of the drive head is then engaged with the second end of the drive shaft. To adjust the tool, the drive shaft is withdrawn, the drive head is pivoted about the perpendicular axis, and the second end of the drive shaft is engaged with the drive gear.

DESCRIPTION OF THE PREFERRED EMBODIMENTS

Figure 1:
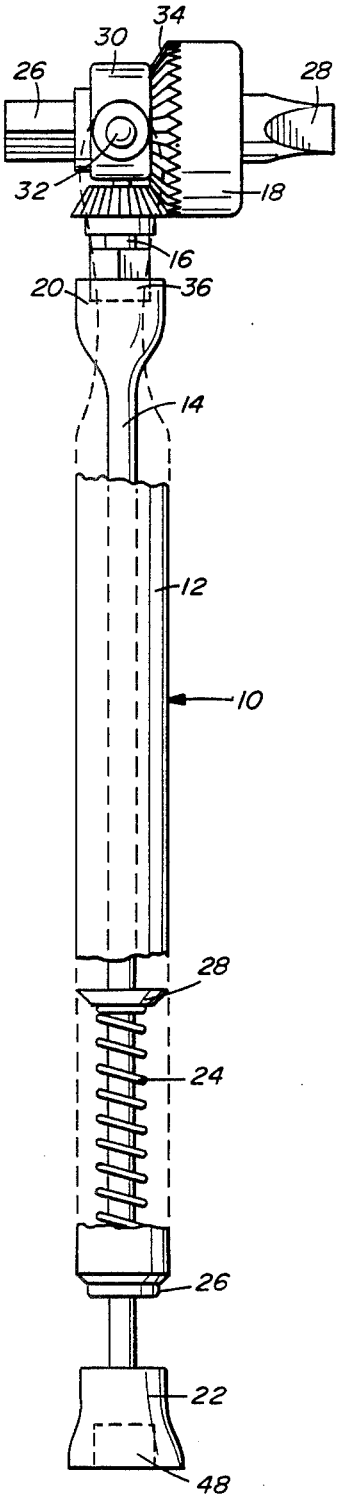
FIG. 1 shows an elevation view, the partial section, of the adjustable tool.

FIG. 1 illustrates one embodiment of the present invention. Tool 10 generally includes handle 12, drive shaft 14, drive gear 16, and drive head 18. Handle 12 is illustrated as an elongated, tubular component. Drive shaft 14 has a first end 22 which is adapted for engagement with a wrench, T-bar, electric or air power drive, or any other device which can impart rational or angular movement to drive shaft 14. Drive shaft 14 also has a second end 20 which is adapted to selectively engage drive gear 16 or drive head 18 or second end 28 as described below.

Thrust spring 24 and thrust spring bushings 26 and 28 are positioned in handle 12 to retain drive shaft 14. The first end 22 of drive shaft 14 can be pulled to partially withdraw second end 20 from handle 12, when the first end 22 of drive shaft 14 is released, spring 24 urges drive shaft 14 back into the initial position relative to handle 12. Drive shaft 14 is shown as a cylindrical shaft interposed within tubular handle 12 so that the longitudinal axis of handle 12 is coincident with the longitudinal axis of drive shaft 14. Drive shaft 14 can be positioned in other configurations relative to handle 12 in other embodiments of the invention.

Drive head 18 includes a first end 26 which is configured to be adaptable to the fastening device. Since the fastening device can be a bolt, nut, screw, or other type of device, the first end 26 of the drive head 18 is preferably shaped to be engaged with an adapter such as a socket or a chuck. Drive head 18 also includes a second end 28 which is configured to be engageable with the second end 20 of drive shaft 14. Drive head 18 is rotatably connected to housing 30, which is pivotably engaged with handle 12. Pins 32 connect housing 30 to handle 12 and permit housing 30 to pivot about an axis (defined by pins 32) which is substantially perpendicular to the longitudinal axis of drive shaft 14 or the longitudinal axis of handle 12.

Figure 2:
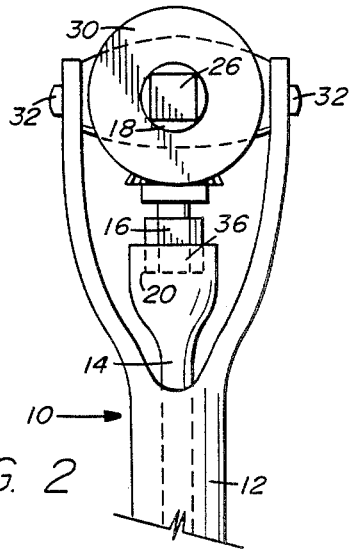
FIGS. 2 and 3 show opposite sides of the tool, and of the drive head.
Figure 3:
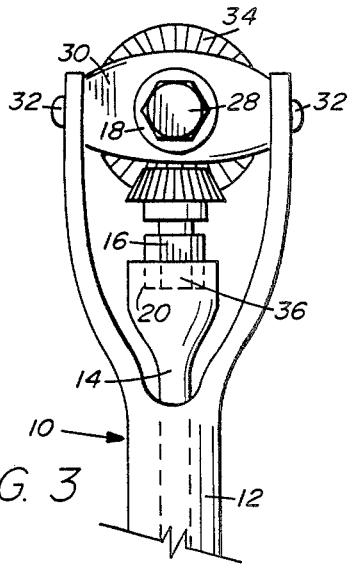

Referring to FIG. 2, the first end 26 of drive head 18 is shown as rectangular in shape. Pins 32 connect housing 30 to handle 12. In other embodiments of the invention, housing 30 can be configured to as an integral part of handle 12. In other embodiments, housing 30 can be an integral part of drive head 18. The second end 20 of drive shaft 14 is engaged with drive gear 16, which is shown as a pinion gear. Referring to FIG. 3, drive gear 16 is shown in engagement with ring gear 34. Ring gear 34 is illustrated as being an integral component of drive head 18. As shown, the second end 28 of drive head 18 is configured as a hexagon to engage with a hexagonal receptacle 36 in the second end 20 of drive shaft 14.

Figure 5:
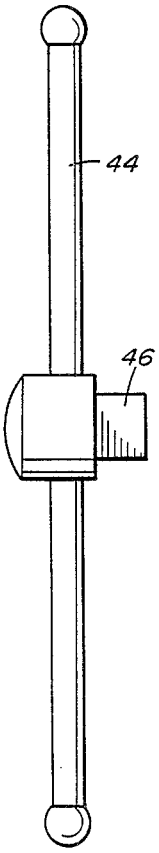
FIG. 5 shows a handle for operating the drive shaft.
Figure 4:
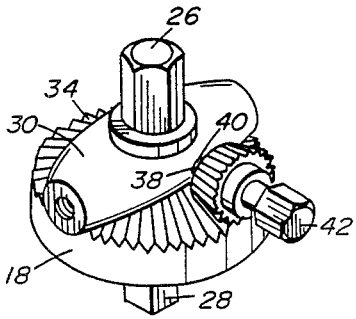
FIG. 4 illustrates the engagement between the drive gear and the drive head.
Figure 6:
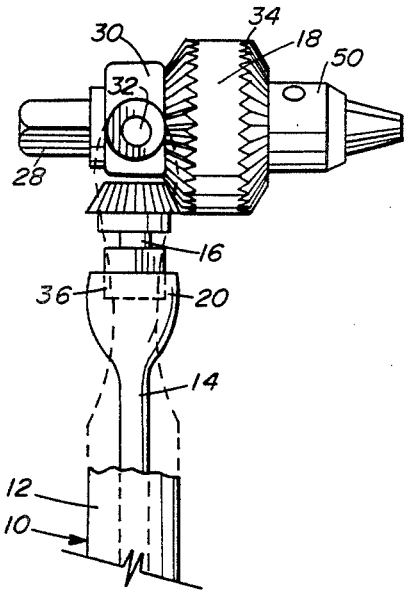
FIG. 6 shows a cluck pivotably engaged with the handle, for operation at angles 90° and 270°.
Figure 7:
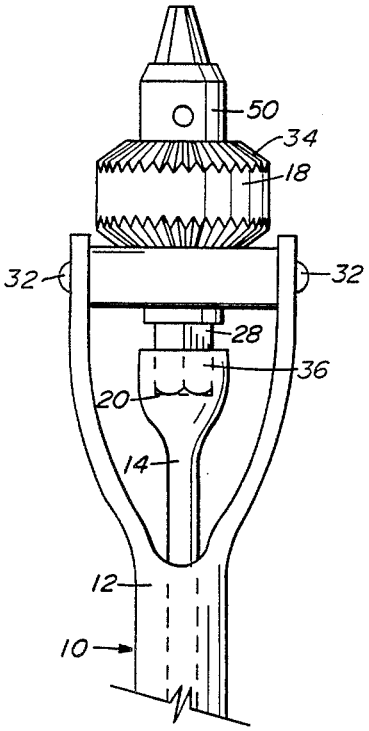
FIG. 7 shows the position of the tool for operation at zero degrees.

Referring to FIG. 4, re-engagement of drive gear 16 and drive head 18 is shown. Drive gear 16 comprises a shaft 38 which is inserted in aperture 40 in housing 30. When drive gear 16 is engaged with drive shaft 14, shaft 38 prevents drive head 18 and housing 30 from pivoting about pins 32. The other end of the drive gear 16, or end 42, is shaped as a hexagon for engagment with a hexagonal receptacle 36 in the second end 20 of drive shaft 14. As shown in FIG. 5, handle 44 has a socket end 46 which can be inserted in aperture 48 located in drive shaft 14. As shown in FIGS. 6 and 7, chuck 50 is attached to drive head 18.

In FIG. 6, drive head 18 rotates about an axis which is perpendicular to the longitudinal axis of handle 12 or drive shaft 14. This is described as the 90° and 270° positions, as representing the angle of this drive axis from the longitudinal axis of handle 12, or drive shaft 14. In FIG. 7, the second end 28 of drive head 18 is engaged with the second end 20 of drive shaft 14. This position is described as the zero degrees position (0°).

The operation of tool 10 can be described as follows. Drive shaft 14 is partially withdrawn from housing 12 by pulling the first end 22 of drive shaft 14 against spring 24. Housing 30 and drive head 18 are pivoted about pins 32 until the second end 28 of drive head 18 is aligned with aperture 36 in the second end 20 of drive shaft 14. Drive shaft 14 is then moved until the second end 20 engages the second end 28 of drive head 18, as shown in FIG. 7. In this zero degrees position, tool 10 operates as a speed wrench for manipulating fastening means. The first end 26 of drive head 18 is engaged with the fastening device (not shown) and drive shaft 14 is rotated clockwise or counterclockwise to manipulate the fastening device.

To modify the tool, drive shaft 14 is withdrawn as previously described and housing 30 and drive head 18 are pivoted about pins 32 until end 42 of drive gear 16 is aligned with receptacle 36. The second end 20 of drive shaft 14 is then moved until drive shaft 14 is engaged with drive gear 16. Rotation of drive shaft 14 thus causes drive gear 16 to rotate ring gear 34 and attached drive head 18.

The tool described herein is operable in the zero degrees, 90°, or 270° degrees positions. In the zero degrees position, the tool operates as a speed wrench. In the 90° and 270° positions, the tool operates as a geared extension tool. By enclosing drive shaft 14 within handle 12, frictional losses are reduced by preventing the rotating drive shaft from contacting exterior components. This reduction in frictional loss correspondingly increases the efficiency of the tool by reducing torque loss. In addition, this feature increases the safety of the tool by preventing operator contact with the rotating drive shaft.

The flexibility of the tool permits the manipulation of fastening means at locations that are difficult to access. The handle of the tool does not required movement during operation to manipulate the fastening device, and various power devices such as a drill, impart wrench, or air rotating tool can be used to operate the drive shaft. The size of the components and materials used can be varied to meet a particular design requirement. For example, a pinion and ring gear drive is shown, but other mechanical gear arrangements can be used without departing from the scope of the invention. The size and composition of the gears can similarly be varied.

The foregoing embodiments are illustrative and do not limit the scope of the invention. Many improvements and modifications can be made to the details set forth herein without departing from the scope of the invention. For example, the inventive concept taught herein is not limited to hand held operations but is extendable to industrial scale applications.

What is claimed is:

1. An apparatus for manipulating a fastening device, comprising:

a handle;

a rotatable drive shaft interposed within said handle, wherein said drive shaft includes a first end and a second end;

a drive head, said drive head includes three angularly spaced shaft engaging portions, said drive head having first means for manipulating the fastening device, said first means being one of said shaft engaging portions, and wherein said drive head further comprises means for selective engagement of one of said engaging portions with said second end of said rotatable drive shaft; and two of said engaging portions having interlocking rotatable gear teeth;

means located at said first end of said rotatable drive shaft for engagement by a rotating mechanism.

2. An apparatus as recited in claim 1, further comprising a spring connected between said handle and said drive shaft for retaining said second end of said drive shaft engagement with a selected one of said engaging portions of said drive head.

3. An apparatus as recited in claim 2, where said spring urges said second end of said drive shaft into engagement with a selected one of said engaging portions.

4. An appartus as recited in claim 1, wherein said first means of said drive head is engageable to a socket.

5. An apparatus as recited in claim 1, wherein said first means of said drive head is engageable to a chuck.

6. An apparatus as recited in claim 1, wherein said first end of said drive shaft is engageable with a drive tool.

7. An apparatus as recited in claim 1, wherein said gear teeth of one of said engaging portions substantially comprises a pinion gear.

8. An apparatus as recited in claim 7, wherein said gear teeth in engagement with said pinion gear substantially comprises a ring gear.

9. An apparatus for manipulating a fastening device, comprising:

an elongated handle;

a rotatable drive shaft interposed within said handle, wherein said drive shaft includes a first end and a second end;

a drive head including a plurality of angularly spaced shaft engaging portions, rotatable means such that each of said portions are selectively rotatably engageable with said second end of said drive shaft, said drive head including a first end having manipulating means for manipulating the fastening device and said manipulating means being one of said engaging portions; and one of said engaging portions having a drive gear thereon in engagement with a drive gear on a second engaging portion, wherein one of said engaging portions is selectively engaged with said second end of said drive shaft, said second engaging portion rotates in response to rotatable operation of said first end of said drive shaft.

10. An apparatus as recited in claim 9, further comprising a spring connected between said handle and said drive shaft for retaining said second end of said drive shaft in engagement with a selected one of said shaft engaging portions.

11. An apparatus as recited in claim 10, wherein said spring urges said second end of said drive shaft into engagment with a selected one of said shaft engaging portions.

12. An apparatus as recited in claim 9, wherein said first end of said drive shaft includes means for engagement with a drive tool.

13. An apparatus as recited in claim 9, wherein said rotatable means includes a housing pivoted to said handle, a portion of said housing includes means for pivoting about an axis which is substantially perpendicular to the longitudinal axis of said elongate handle.

14. An apparatus as recited in claim 9, wherein said handle includes a substantially tubular shaft, and wherein the longitudinal axis of said tubular shaft coincides with the longitudinal axis of said drive shaft.

15. An apparatus for manipulating a fastening device, comprising:

a substantially tubular handle;

a housing pivotably engaged with one end of said handle;

a rotatable drive shaft concentrically interposed within said handle, wherein said drive shaft includes a first end and a second end, said second end engaged to said housing;

a drive head rotatably engaged with said housing, wherein said drive head includes a plurality of angularly spaced shaft engaging portions for selective engagement with the second end at said drive shaft, each of said portions including a first end having means for manipulating the fastening device;

a drive head gear attached to one of said shaft engaging portions; and a drive gear attached to a second of said shaft engaging portions and engaging with said drive head gear and wherein when said one of said shaft engaging portions is selectively engaged with the second end of said drive shaft said second engaging portion rotates in response to rotatable operation of said first end of said drive shaft to rotatably manipulate the fastening device.

16. An apparatus as recited in claim 15, further comprising a spring connected between said handle and said drive shaft for retaining the second end of said drive shaft in engagement with a selected one of said engaging portions.

17. An apparatus as recited in claim 16, wherein said spring urges said second end of said drive shaft into engagement with said one of said engaging portions.

18. An apparatus as recited in claim 15, wherein said housing pivots about on axis which is substantially perpendicular to the longitudinal axis of said handle.

19. An apparatus as recited in claim 15, wherein said first end of one of said shaft engaging portion includes means for engagement to a socket.

20. An apparatus as recited in claim 15, wherein said first end of one of said shaft engaging portion includes means for engagement to a chuck.

21. An apparatus as recited in claim 15 wherein said first end of said drive shaft includes means for engagement with a drive tool.

22. An apparatus as recited in claim 15, wherein said drive head gear comprises a ring gear.

23. An apparatus as recited in claim 22, wherein said drive gear comprises a pinion gear for engagement with said ring gear.

24. A method for manipulating a fastening device selectively with a plurality of heads, comprising the steps of:

withdrawing a second end of a drive shaft, said drive shaft having a first and second end and being located within an elongated handle, from rotatable engagement with one of the heads;

pivoting a housing holding the plurality of heads and engaged with said handle about an axis which is substantially perpendicular to the longitudinal axis of said handle, until a second of the plurality of heads is positioned to be rotatably engaged with said second end of said drive shaft;

releasing said second end of said drive shaft for engagement with the second head;

engaging the fastening device with one of the plurality of heads;

manipulating said drive shaft while substantially maintaining the position of said handle, whereby the fastening device is manipulated by rotating said first end of said drive shaft and engaged head to manipulate the fastening device;

withdrawing the second end of said drive shaft from engagement with the second head;

further pivoting said housing until a drive gear engaged with another of the heads is aligned with the second end of said drive shaft;

releasing the drive shaft into engagement with said another head;

engaging the fastening device with one of the heads; and rotating the shaft to rotate the fastening device.

25. A method as recited in claim 24, further comprising the step of releasing the second end of said drive shaft for engagement with said another head.

26. A method as recited in claim 25, further comprising the step of positioning a first end of said drive engaging one of the heads with the fastening device.

27. A method as recited in claim 26, further comprising the step of rotating the first end of said drive shaft, and drive gear and head engaged thereto, to manipulate the fastening device.

* * * * *